US005249942A

United States Patent [19]

Torii et al.

[11] Patent Number: 5,249,942

[45] Date of Patent: Oct. 5, 1993

[54] OIL PUMP

[75] Inventors: Akira Torii; Shioji Morita, both of Kanagawa, Japan

[73] Assignee: Atsugi Unisia Corporation, Japan

[21] Appl. No.: 840,191

[22] Filed: Feb. 24, 1992

[30] Foreign Application Priority Data

Feb. 28, 1991 [JP] Japan ..... 3-010127[U]

[51] Int. Cl.[5] ..... F04C 2/10

[52] U.S. Cl. ..... 418/171

[58] Field of Search ..... 418/166, 169, 170, 171

[56] References Cited

U.S. PATENT DOCUMENTS 3,695,791 10/1972 Brundage ..... 418/171 X
3,791,778 2/1974 Eron ..... 418/167 X
4,897,025 1/1990 Negishi ..... 418/171
5,122,039 6/1992 Tuckey ..... 418/166 X

FOREIGN PATENT DOCUMENTS 63-78182 5/1988 Japan .

*Primary Examiner*—Richard E. Gluck
*Attorney, Agent, or Firm*—Ronald P. Kananen

[57] ABSTRACT

An oil pump comprises a pump casing, a crankshaft, an inner rotor mounted on the crankshaft, an outer rotor, an intake chamber, and a discharge chamber. The inner rotor has outwardly projecting teeth which engage with inwardly projecting teeth of the outer rotor for rotating the outer rotor for transferring oil from the intake chamber to the discharge chamber. A stopper is provided which contacts edge portions of the teeth of the inner and outer rotors respectively to prevent oil in a space between the teeth from leaking.

4 Claims, 2 Drawing Sheets

OIL PUMP

BACKGROUND OF THE INVENTION

1. Field of The Invention

The present invention relates generally to an oil pump for automotive applications. Particularly, the present invention relates to an oil pump in which flow rate reduction is prevented.

2. Description of The Prior Art

A conventional oil pump is comprised basically of a pump casing housing rotatable crankshaft. An inner rotor with outwardly projecting tooth portions is mounted on the crankshaft, the tooth portions of the inner rotor mesh, on one side thereof, with inwardly projecting teeth provided on an outer rotor for causing the outer rotor to rotate, thus pumping oil from an intake port provided on one side of the inner and outer rotors to a discharge port on the opposite side. However, because the oil is transferred in pockets formed in-between the teeth of the inner and outer rotor at a lower portion where the engagement therebetween is minimum, there is a tendency for oil to leak from between the teeth at a point just before a fully closed position when the oil pocket is transferred. Thus, the discharge volume of the pump may vary undesirably and the flow from the pump may become unstable.

SUMMARY OF THE INVENTION

It is therefore a principal object of the present invention to provide an oil pump in which reduction of a discharge volume is prevented.

In order to accomplish the aforementioned and other objects, an oil pump is provided, comprising: a pump casing; a rotatable shaft disposed through the pump casing; an inner rotor mounted on the rotatable shaft, the inner rotor having outwardly projecting first tooth portions around a circumference thereof; an outer rotor, the outer rotor being ring shaped and having inwardly projecting second tooth portions formed around an inner circumference thereof for engaging with the first tooth portions of the inner rotor at one side thereof so as to be rotated by the inner rotor; an intake chamber facing the inner and outer rotors between an area in which the respective first and second tooth portions assume a maximally engaged position to an area just before the respective first and second tooth portions assume a minimally engaged position; a discharge chamber, facing the inner and outer rotors at a side opposing that of the intake chamber; and a stopper portions, positioned so as to contact touching ends of the first and second tooth portions at the position just before the first and second tooth portions assume a minimally engaged position for preventing oil in a space defined between the first and second tooth portions from escaping.

DESCRIPTION OF THE PREFERRED EMBODIMENT

Figure 1:
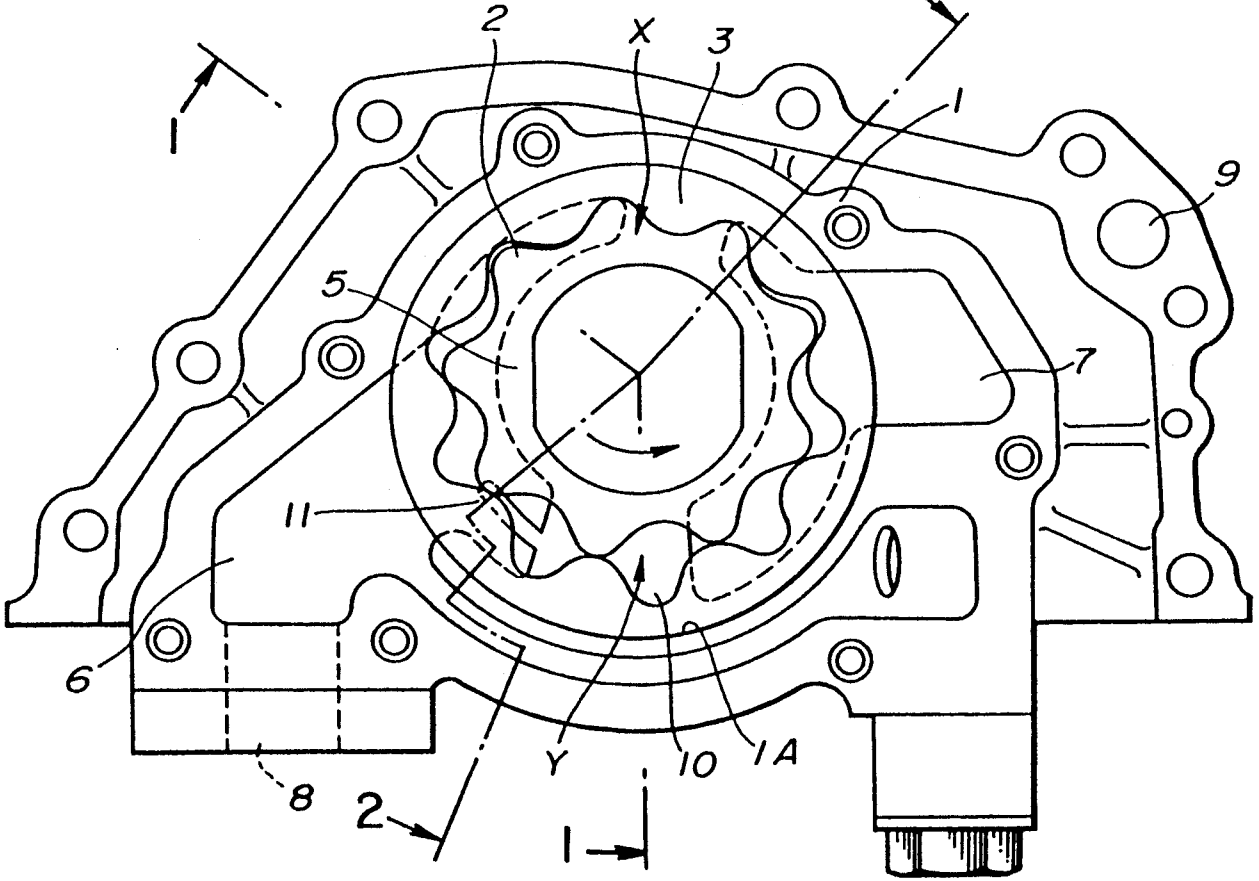
FIG. 1 is a plan view of an oil pump according to the present invention.
Figure 3:
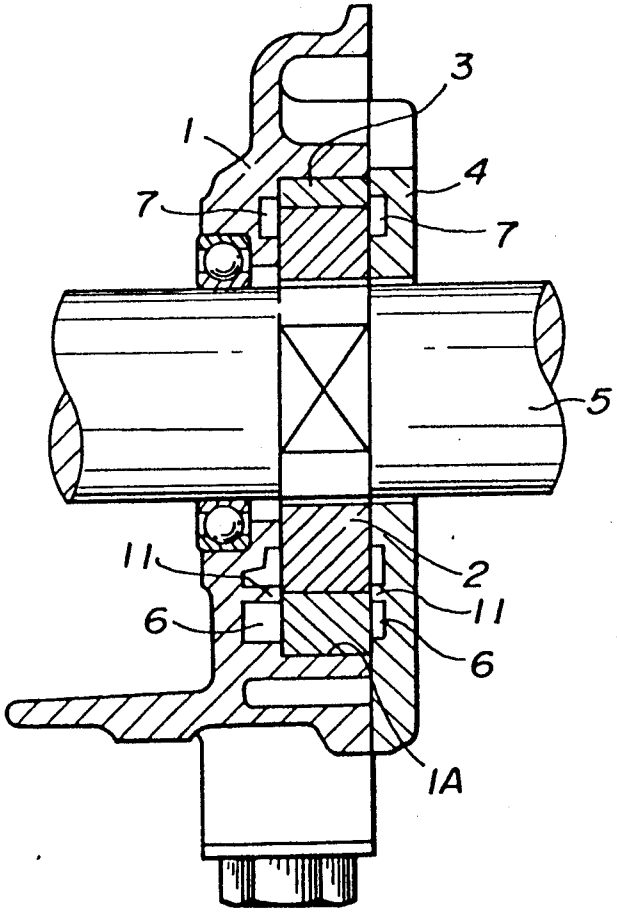
FIG. 3 is a cross-sectional view taken along line B—B of FIG. 1.
Figure 2:
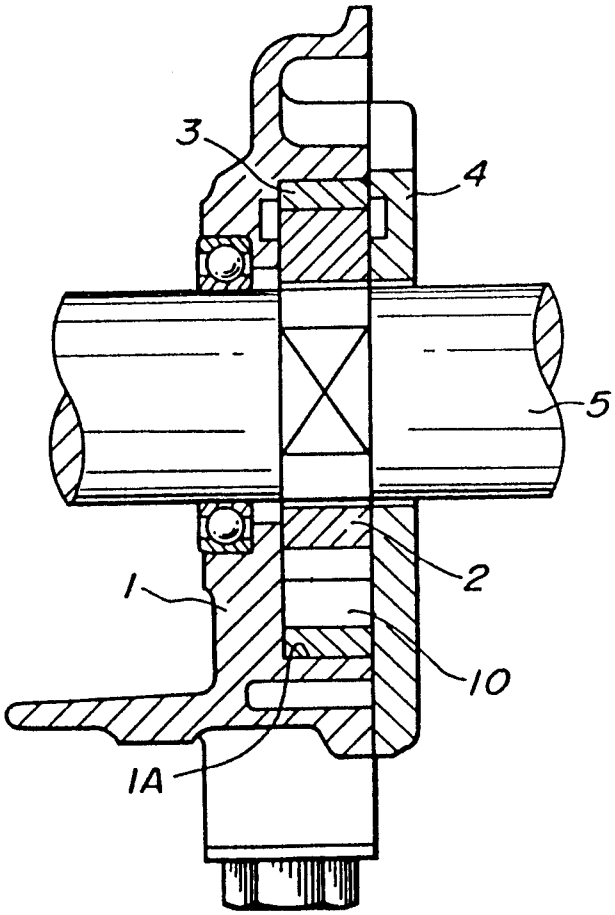
FIG. 2 is a cross-sectional view taken along line A—A of FIG. 1.

Referring now to the drawings, particularly to FIG. 1, an oil pump according to the present invention comprises a pump casing 1, an inner rotor 2 with outwardly projecting tooth-like projections and an outer rotor 3 with inwardly projecting tooth-like projections engageable with the projections of the inner rotor 2. As best seen in FIG. 2, a cover 4 is provided for covering a front portion of the casing 1. A rotatable crankshaft 5 is provided through a substantially center area of the pump casing 1, the inner rotor 2 being mounted on the crankshaft 5. An oil intake chamber 6 is formed in the pump casing 1. The intake chamber 6 is formed facing the inner and outer rotors at a position between a position X, indicating maximum engagement of the rotor teeth to just before a position Y, indicating a closed condition of an oil transfer chamber 10 which is formed between the teeth of the outer and inner rotors when the engagement between the teeth is minimum. Opposite the oil intake chamber 6, disposed on the other side of the crankshaft 5, a discharge chamber 7 is provided. As can be seen in FIG. 3, the intake chamber 6 and discharge chamber 7 are covered by the cover 4 in which are formed depressions which form portions of the chambers 6 and 7.

The intake chamber 6 is connected to an oil intake passage 8, which may be a pipe or such like, for communicating with a fluid source and the discharge chamber 7 is connected to a discharge passage 9. The intake passage 8 communicates via the intake chamber 6 with a volume chamber 10 which is defined in a space formed between contacting ends of the teeth of the inner rotor 2 and those of the outer rotor 3. As the rotors rotate past the closed position Y, the oil in the volume chamber 10 is introduced to the discharge chamber 7 to be discharged via the discharge passage 9 to a vehicle engine (not shown), for example.

Referring to FIG. 3, a stopper 11 is formed at a lower portion of the pump, proximate the Y, or minimum engagement position, in the pump casing 1 and the cover 4 respectively. The stopper 11 touches the tips the teeth engaged just before the closed position Y of the inner rotor 2 and the outer rotor 3 respectively for preventing loss of oil just before the teeth proceed to the closed position Y. The stopper 11 may be formed as a sealing rib member directly adjacent the inner and outer rotors 2 and 3 at each axial end thereof, a curve of the rib being substantially that of a circumference defined by top surfaces of the inwardly projecting tooth portions of the outer rotor 3 and positioned so as to make sliding contact with axial sides of the teeth of the inner and outer rotors respectively just before the teeth reach the closed position Y for defining the oil transfer chamber 10. Thus reduction of the discharge volume of the pump may be prevented.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An oil pump comprising:

a pump casing;

a rotatable shaft disposed through said pump casing;

an inner rotor mounted on said rotatable shaft, said inner rotor having outwardly projecting first tooth portions around a circumference thereof;

an outer rotor, said outer rotor being ring shaped and rotatably and eccentrically disposed in relation to said inner rotor and having inwardly projecting second tooth portions formed around an inner circumference thereof for engaging with said first tooth portions of said inner rotor at one side thereof so as to be rotated by said inner rotor;

an intake chamber facing said inner and outer rotors between an area in which the respective first and second tooth portions assume a maximally engaged position to an area just before the respective first and second tooth portions assume a minimally engaged position;

a discharge chamber, facing said inner and outer rotors at a side opposing that of said intake chamber; and a sealing rib, positioned substantially along a circumference defined by a path generated by movement of an innermost surface of said inwardly projecting second tooth portions for a predetermined distance so as to contact touching ends of said first and second tooth portions at said position just before said first and second tooth portions assume a minimally engaged position and preventing oil in a space defined between said first and second tooth portions from escaping.

2. An oil pump as set forth in claim 1, wherein said sealing rib is defined in said pump casing.

3. An oil pump as set forth in claim 1, further including a cover, wherein said sealing rib is defined in said cover and said casing.

4. An oil pump as set forth in claim 1, wherein said intake chamber is associated with an intake port for supplying oil to said pump and said discharge chamber is associated with a discharge port for supplying oil to an automotive engine.

* * * * *